United States Patent [19]

Green

[11] 3,944,077

[45] Mar. 16, 1976

[54] SHUFFLE FEED SIZING MECHANISM

[75] Inventor: Chester Green, San Jose, Calif.

[73] Assignees: Genevieve I. Hanscom; Genevieve I. Hanscom, Robert Magnuson, Lois J. Thomson, trustees of the estate of Roy M. Magnuson, all of San Jose, Calif. ; part interest to each

[22] Filed: Aug. 23, 1972

[21] Appl. No.: 283,209

Related U.S. Application Data

[63] Continuation-in-part of Ser. No. 168,094, Aug. 2, 1971, abandoned, which is a continuation-in-part of Ser. Nos. 706,505, Feb. 19, 1968, Pat. No. 3,543,928, and Ser. No. 33,814, May 1, 1970, abandoned.

[52] U.S. Cl. ..... 209/73; 209/98; 209/379

[51] Int. Cl. ..... B07b 1/15

[58] Field of Search ..... 209/97, 98, 73, 83, 85, 209/379; 198/218

[56] References Cited

UNITED STATES PATENTS 3,640,378 2/1972 Elliott ..... 209/98

*Primary Examiner*—Allen N. Knowles

*Attorney, Agent, or Firm*—Gerald L. Moore

[57] ABSTRACT

A shuffle feed sizing structure wherein articles are progressed from valley to valley over a shuffle feed mechanism and as they progress the article advancing face of the shuffle feed member provides a sizing opening of a given width so that the articles small enough to fall through the opening are discharged downwardly beneath the shuffle feed at this point. Various widths of sizing opening are provided between the faces of the shuffle feed as required and the largest articles are discharged over the end. Means are also provided for ejecting articles from a sizing opening if they tend to become wedge or if they remain in front of the sizing opening but are too large to pass through the opening.

7 Claims, 14 Drawing Figures

INVENTOR.
CHESTER GREEN

BY Allen and Chromy

ATTORNEYS

FIG. 2
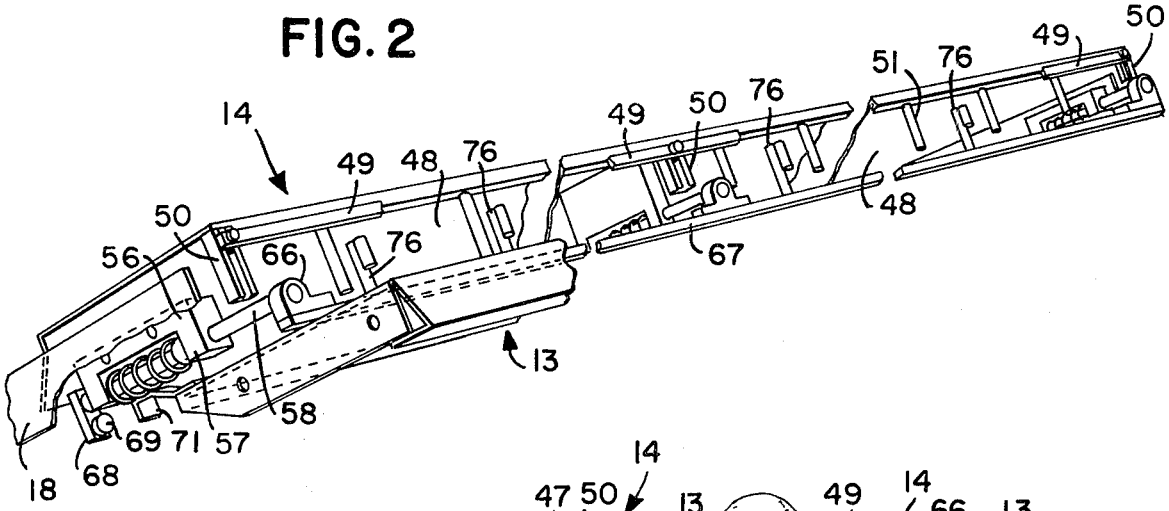
FIG. 3
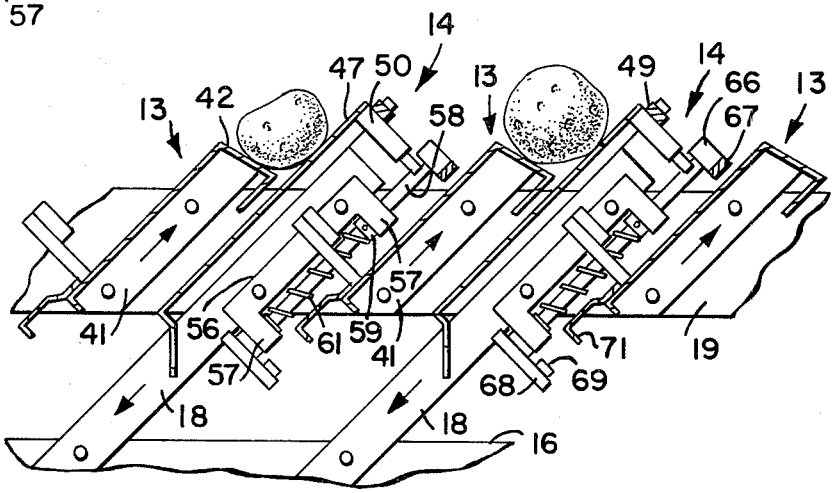
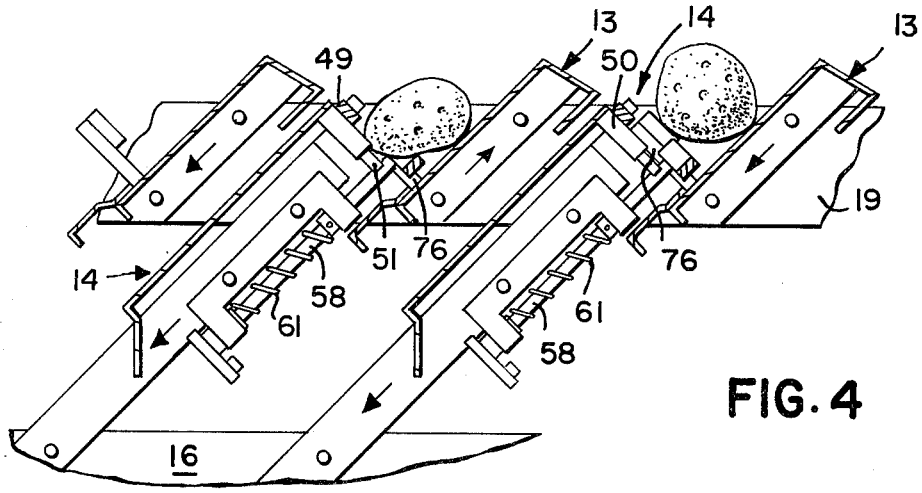
FIG. 4
INVENTOR.
CHESTER GREEN
BY
Allen and Chromy
ATTORNEYS FIG. 5
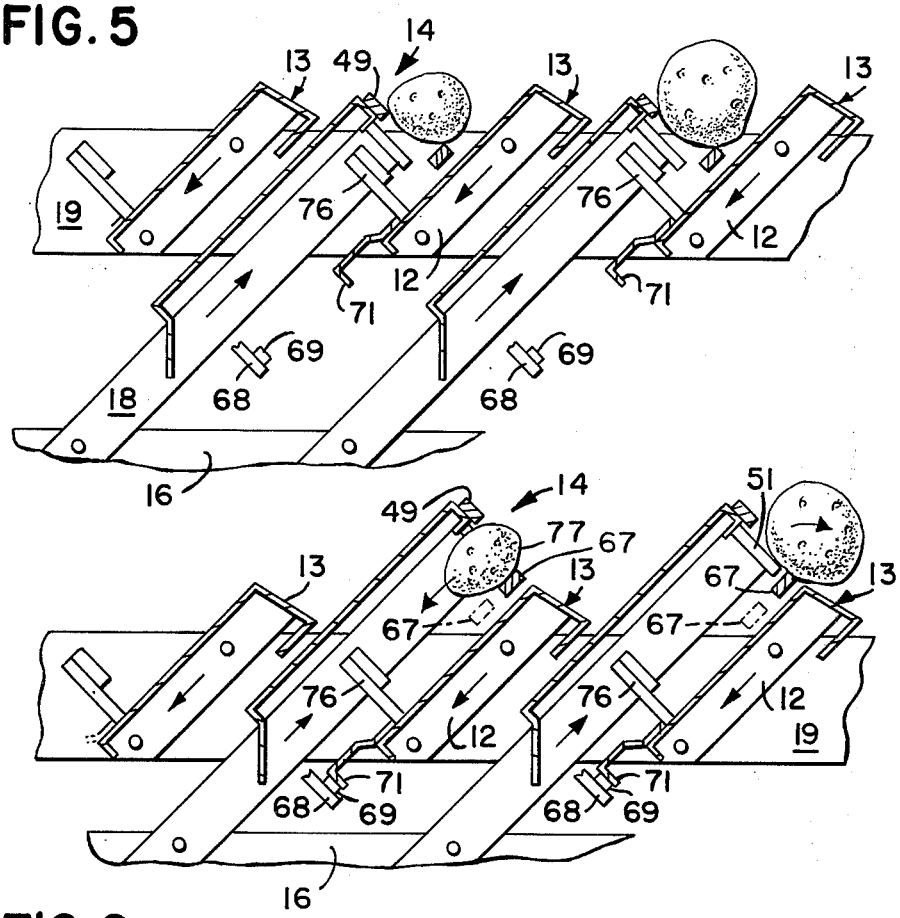
FIG. 6
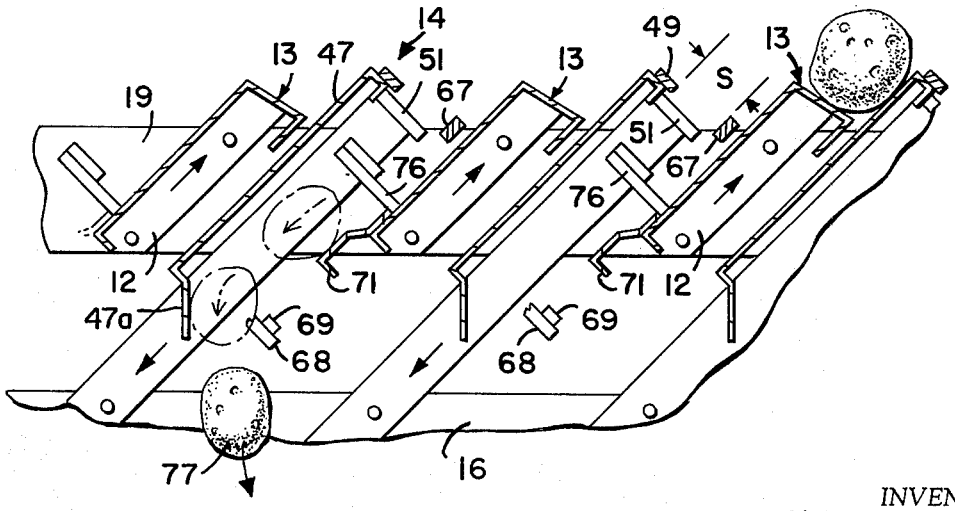
FIG. 7
INVENTOR.
CHESTER GREEN
BY Allen and Hromy
ATTORNEYS

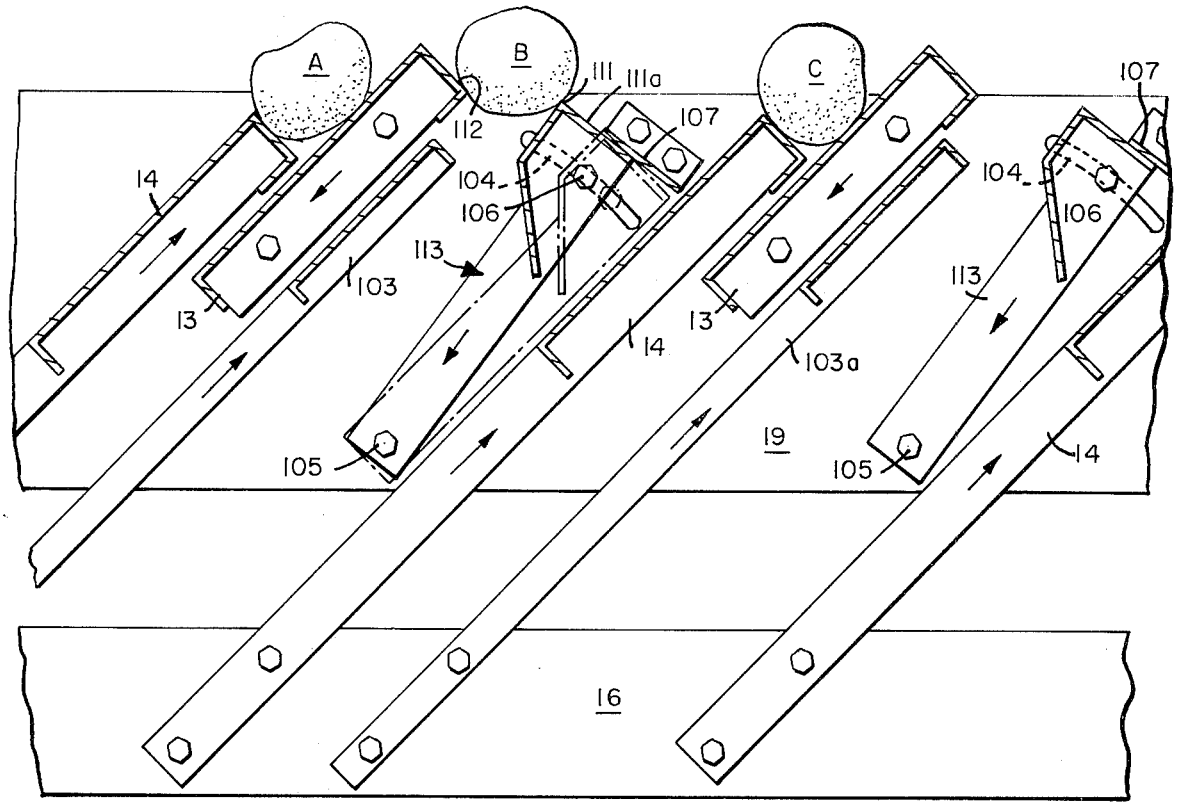
FIG. 8
FIG. 9
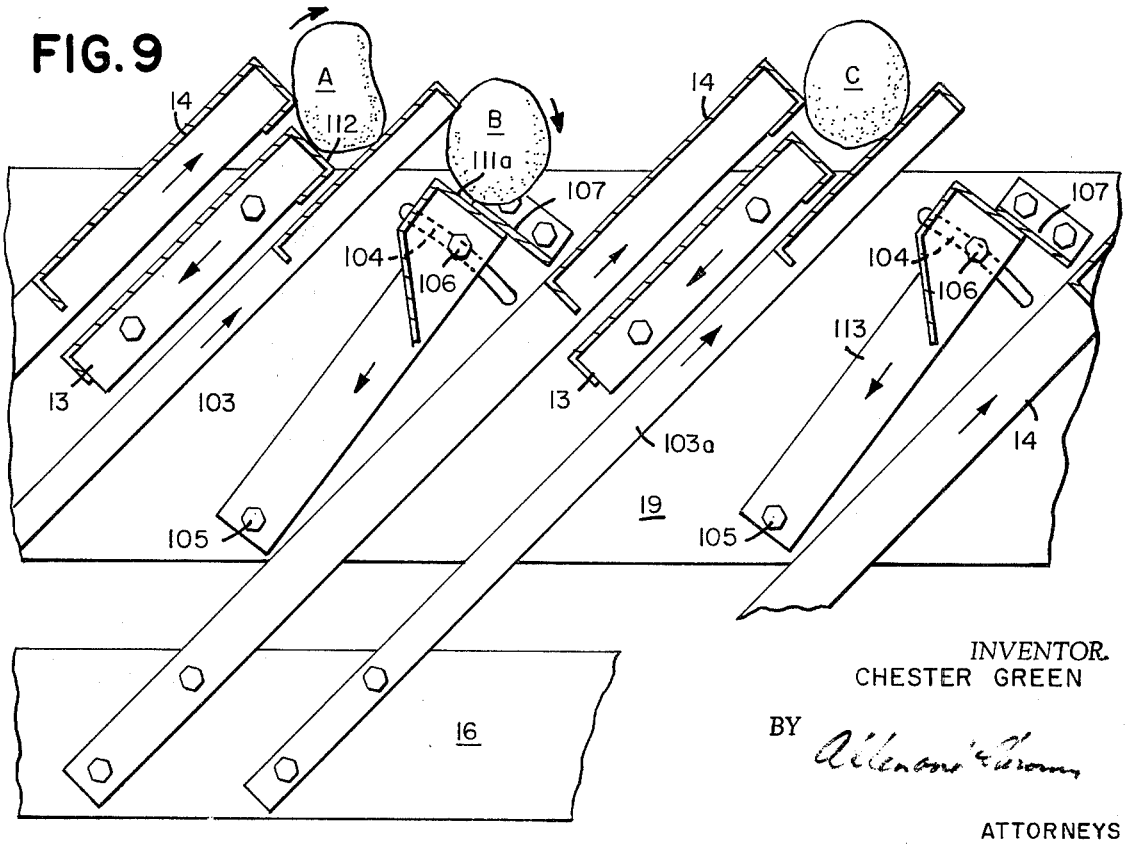
INVENTOR.
CHESTER GREEN
BY Allenson & Brown
ATTORNEYS FIG. 12
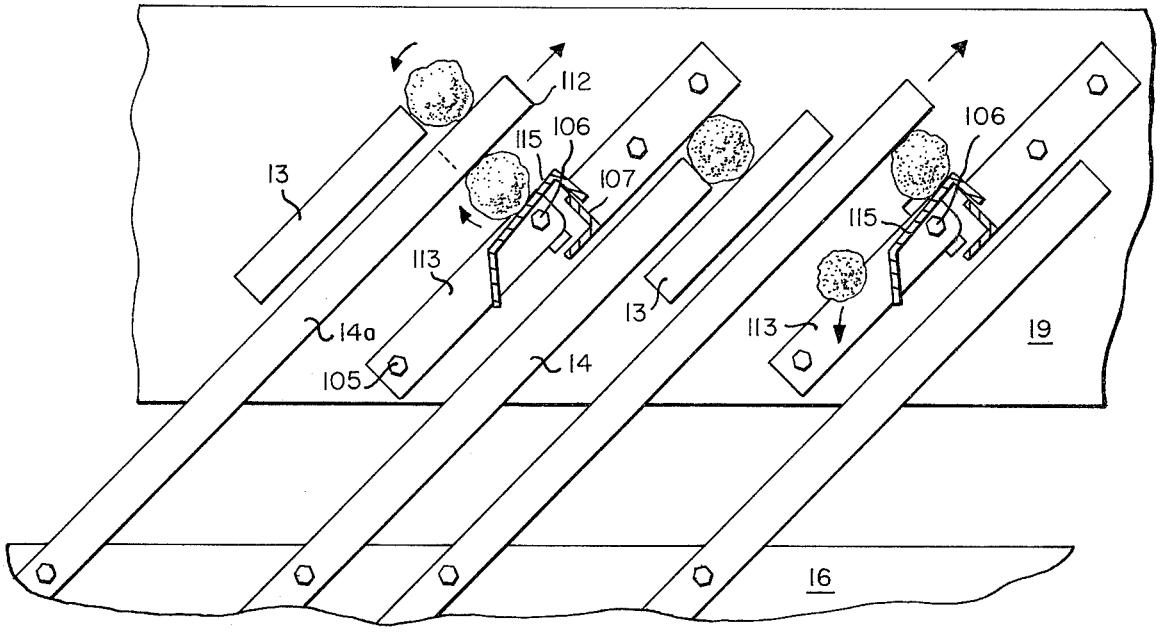
FIG. 13
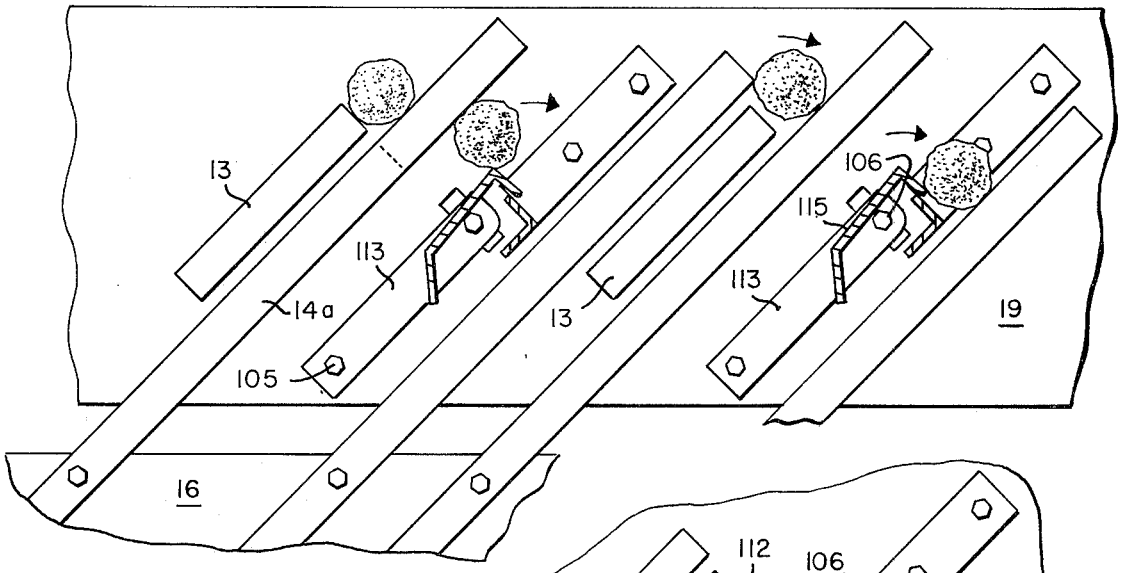
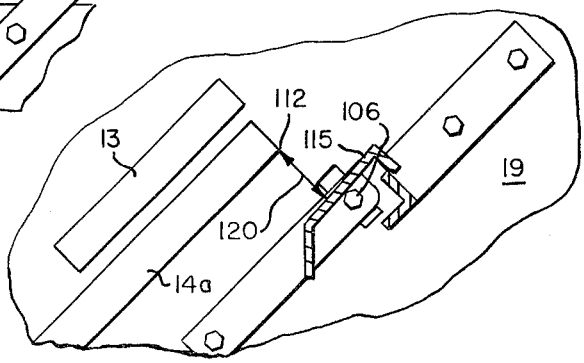
FIG. 14

SHUFFLE FEED SIZING MECHANISM

This application is a continuation-in-part of my copending application Ser. No. 168,094 filed Aug. 2, 1971, now abandoned, which application was a continuation-in-part of applications Ser. No. 706,505 filed Feb. 19, 1968 and now U.S. Pat. No. 3,543,928, and Ser. No. 33,814 filed May 1, 1970 and now abandoned.

DESCRIPTION OF THE INVENTION

This invention is concerned with the use of the shuffle feed members of the usual type of shuffle feed mechanism to provide a sizing operation on articles being progressed over the shuffle feed. After the articles have been aligned at the bottom of the shuffle feed mechanism, so as to be oriented lengthwise in a row, the sizing operation begins, and, as the articles are advanced by a shuffle feed member having a sizing opening in its article advancing face, the articles are turned so that the smallest diameter of the article is presented to the opening for the sizing operation. The sorting openings become progressively wider as the articles are progressed along the shuffle feed.

Accordingly, it is an object of the invention to provide a shuffle feed mechanism which will perform a sizing operation during the shuffle feed of the articles and wherein the sizing is controlled by the relatively reciprocating shuffle feed members during their reciprocation to form a sizing opening.

It is another of the invention to provide a sizing mechanism whereby the shuffle feed members include sizing as it is controlled by a pair of relatively movable bars, the lower one of which can be moved rearwardly to allow the sizing opening to become larger and to assist in dislodging a wedged article and to reject a larger article.

A further object of the invention is to provide a shuffle feed mechanism of the character to size objects wherein the control of the ejection of articles from a sizing opening is effected by engagement of relatively movable shuffle feed members during their reciprocation with respect to each other.

Still another object of the invention is to provide a shuffle feed mechanism of the character to size objects wherein the control of the sizing is performed by reciprocating members of the sets of shuffle feed members with certain additional spacing between certain members longitudinally of the machine.

It is still another object of the invention to provide a shuffle feed member wherein the shuffle members are adjustable toward and from each other to vary the spacing of the article to be sized therethrough.

A still further object of the invention is to provide a shuffle feed mechanism which can be useful with rollable articles such as pickles.

Other objects and advantages of the invention will be apparent from the following description of a preferred embodiment of the invention, as illustrated in the accompanying drawings, in which:

FIG. 2 is a fragmentary front perspective of a sizing face of one of the shuffle feed sizing members;

FIG. 3 is a schematic side elevational view, partly in section, with certain parts omitted, and illustrating one phase of the sizing operation;

FIG. 4 is a view similar to FIG. 3 but illustrating the shuffle feed members as they are discharging an object to be sized such as a potato for example, such as an Irish potato, from the top of a sizing shuffle feed in front of the sizing face thereof;

Figure 10:
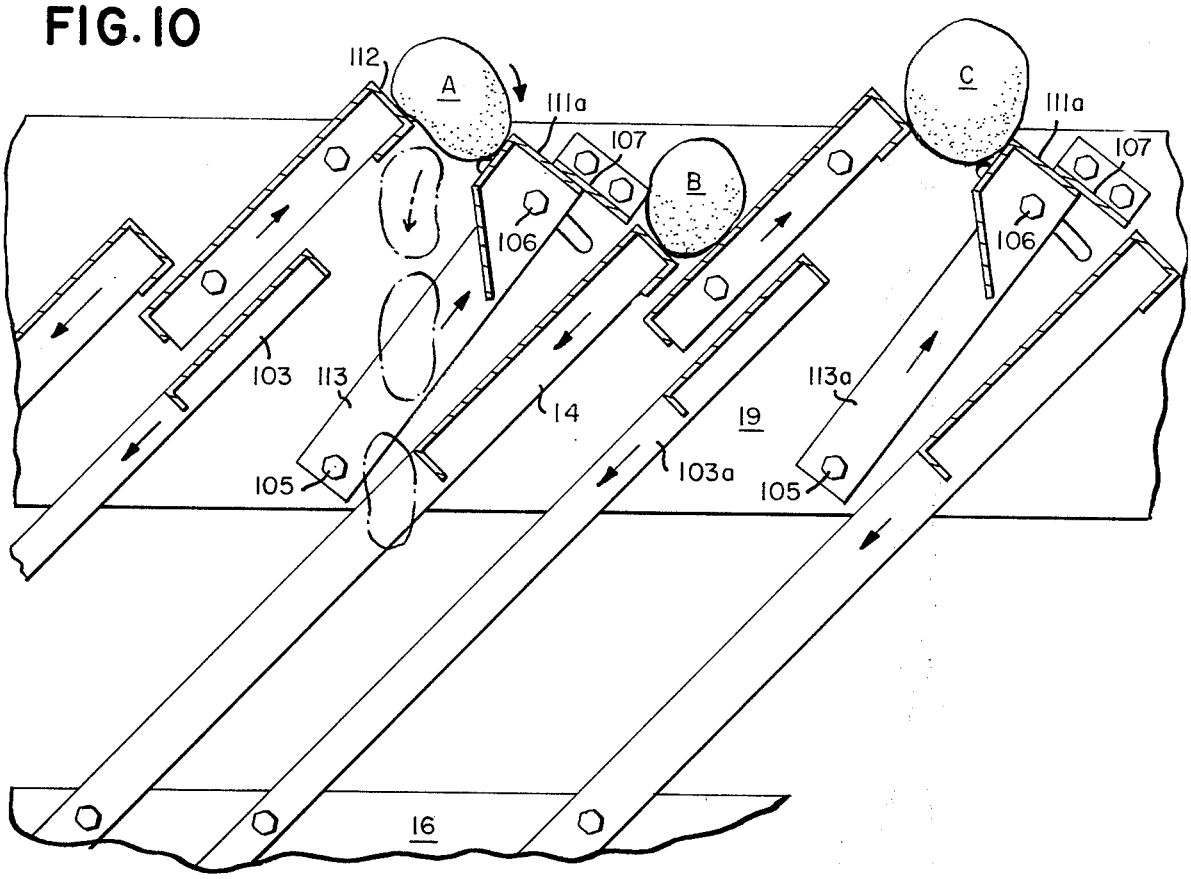
Figure 11:
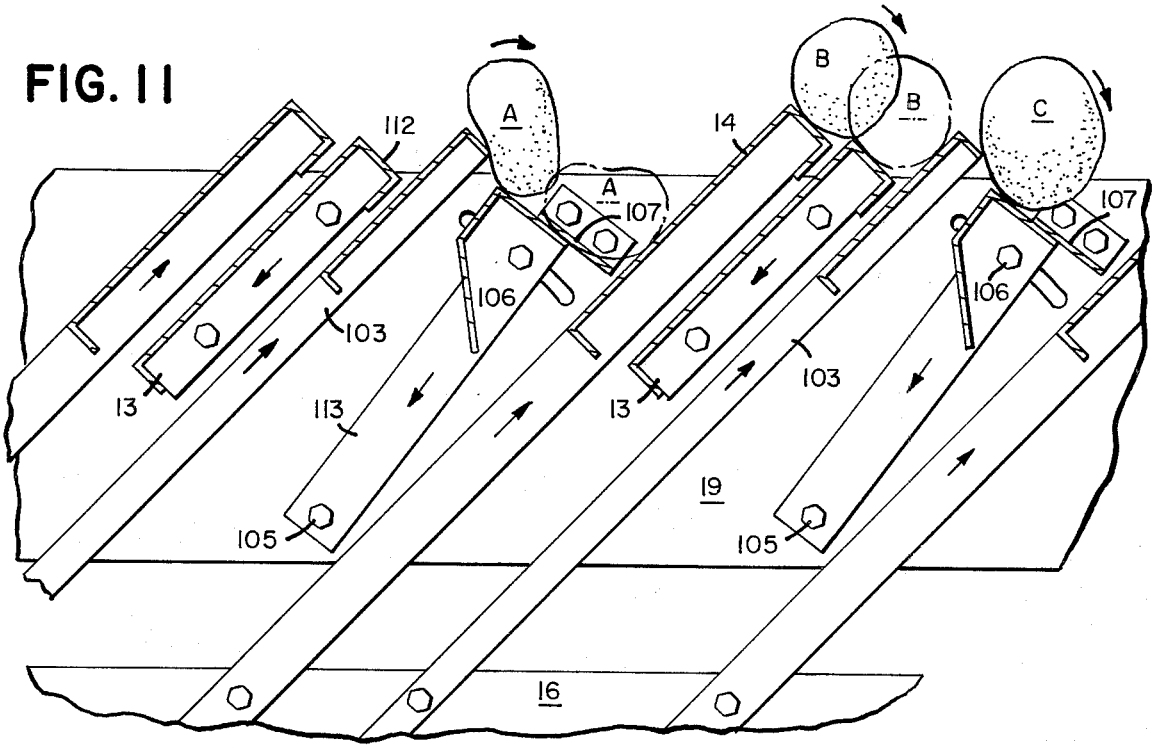

FIGS. 5, 6 and 7 are views similar to FIGS. 3 and 4 illustrating the sizing operation of the shuffle feed sizing structure at different portions of their cycle than those illustrated in FIGS. 3 and 4;

FIG. 8 is a sectional elevational view showing the parts as positioned during the sizing portion of the cycle;

FIG. 9 is a view similar to FIG. 8 but showing the shuffle feed mechanism at the time of the cycle when an article is being rejected from the sizing opening;

FIG. 10 is a view similar to FIGS. 8 and 9 illustrating the parts where a certain article is being sized and a subsequent one is about to be rejected; and FIG. 11 shows the parts of the shuffle feed mechanism during the rejecting portion of the cycle.

FIGS. 12 and 13 illustrative a further modified form of the invention which is generally similar to FIGS. 8 and 9. FIG. 12 shows the upper sizing opening occupied by an article such as a pickle, which is too large to pass through the sizing opening and is fed along for further sizing operations.

FIG. 14 is a fragmentary view similar to FIGS. 12 and 13, but showing the parts as positioned when sizing opening is defined.

Figure 1:
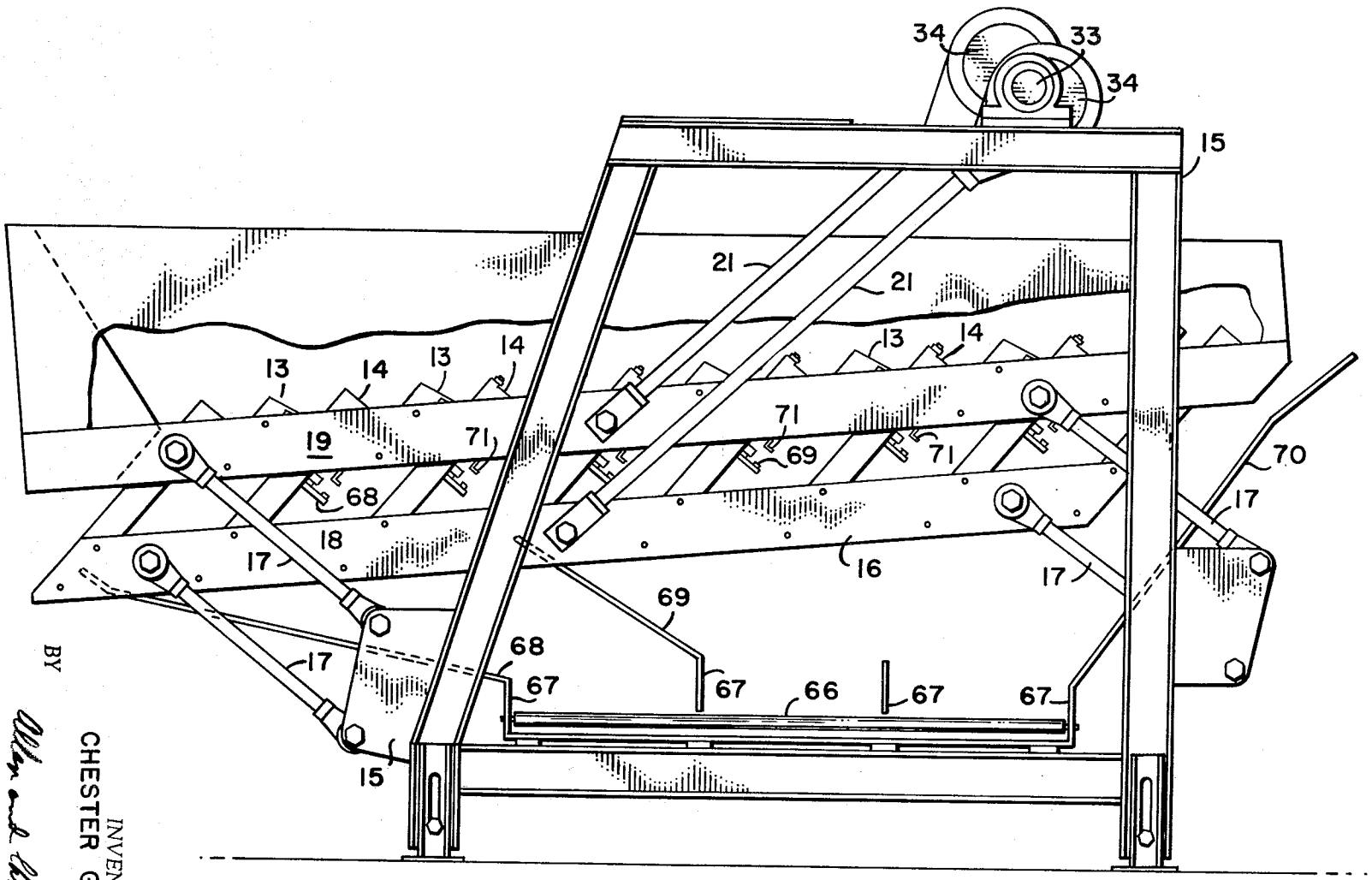
FIG. 1 is a side elevational view of a shuffle feed mechanism sizing structure.

Generally, the shuffle feed structure 11 (FIGS. 1, 2 and 3) comprises similar movable sets of shuffle members 13 and shuffle members 14 which are generally rectangular in their construction and are mounted in inclined position having a long upwardly facing article supporting portion and a short upwardly facing article feeding and supporting portion. The shuffle feed members 13 extend between and are secured to opposite frame members 19 in the form of side plates which confine the articles within the transverse dimension of the shuffle feed. The opposite frame members 19 are supported from the frame 15 by four parallel links 17. The other shuffle feed members 14 are carried by upwardly projecting angles 18 from a pair of opposite frame members or plates 16 which are supported also by four parallel links 17. Only two links 17 of each set are seen in FIG. 1. The means for driving or reciprocating the sets of shuffle feed members in opposite directions comprises a motor driven transverse shaft 33 (FIG. 1) suitably journalled on the frame and carrying respective pairs of oppositely disposed eccentrics 34 whose eccentric followers are connected by the links 21 with the upper set of shuffle members 13 and the lower set of shuffle members 14, respectively. Only two eccentrics are shown in FIG. 1. These shuffle members move in opposite directions simultaneously to effect the feeding movement.

The shuffle feed sizing member 14 (FIGS. 2, 3 & 4) includes an upper article supporting surface 47 having depending posts 50 at its upper front corners so that an opening 48 is provided in the article advancing face of this shuffle feed member 14. The rear edge 47*a* of the surface 47 is angled downwardly to deflect potatoes (FIG. 7) in this direction. A bar 49 extends across and defines the top of the opening 48 and has depending therefrom a transverse series of vertical spacers 51 which serve to divide the sizing opening into appropriate spaces and maintain the lateral positioning of the potatoes in rows.

The lower edge of the sizing opening is defined by a transverse bar 67 (FIGS. 2 and 3) and this bar 67 is movable under certain conditions from its normal sizing position to enlarge the sizing opening. For this purpose the bar carries three supporting fixtures or members 66 having apertured bosses to receive the front ends of respective guide rods 58, each of which is carried by a bracket 56 having at each end a depending apertured lug 57 (FIG. 3) to carry the shaft 58. The two end brackets 56 are secured to the supporting angles 18 (FIG. 2) and the central bracket 56 is secured to the top surface 47 of the shuffle member 14. A spring 61 (FIGS. 2, 3 and 4) is disposed about each shaft 58 and at its rearward end abuts an apertured boss 57 and at its front end abuts a collar 59 pinned to the cooperating shaft 58. As a result the lower bar 57 is spring-held in the position shown in FIGS. 2 – 4 to define a normal sizing opening.

As seen in FIGS. 3 and 4 the rear end of each shaft 61 carries a depending arm 68 having a stop pin 69 at the front thereof opposed to a rearwardly extending flange bracket 71 on the adjacent lower shuffle feed member 13. As seen in FIGS. 4 and 5 the two abutments comprising the stop 69 and the stop flange 71 are at their furthest apart spaced position.

The operation of the shuffle feed mechanism is illustrated further in FIGS. 5, 6 and 7. FIG. 5 showing the position of the shuffle feed members when the full sizing opening marked S is available between the sizing bars 49 and 67, and in which upright ejector bars 76 carried in a transverse series across the top of each shuffle feed member 13 are spaced from the sizing opening.

FIG. 6 shows the shuffle feed members 14 advancing and the shuffle members 13 receding with a potato 77 shown entering the sizing opening, the stop 71 shown engaging with and activating the stops 69 carried by the support rods 58 for the lower bar 67. The springs 61 are being compressed and the lower bar 67 is retracted with respect to the sizing opening so that a larger opening is provided. The furthest retracted position of sizing bar 67 is illustrated in dotted lines.

In FIG. 4 the shuffle members 13 are in their furthermost advanced position and the shuffle members 14 are in their furthermost retracted position. With this condition of the parts the ejector bars 76 have entered the sizing opening 48, one ejector bar 76 between each pair of depending pins 51, to eject any wedged potato from the sizing opening as seen at the righs of FIG. 4. The rejected potato will be fed over the shuffle feed member 13 in front of its advancing face 42 and carried forwardly to the next larger sizing opening.

Referring to FIG. 1 a transverse feed belt 66 extends underneath the shuffle feed members and has various partition members 67 supported thereabove to divide the belt into different compartments to receive different sizes of the articles being sorted. The smaller potatoes are directed by chute 68 into one belt path, the intermediate size are directed by a chute 69 to a middle belt path and the larger potatoes being sized will be directed by chute 70 to the rightmost compartment or belt path.

Referring to FIGS. 8 through 11 there is shown a modified form of the invention wherein the upper set of shuffle members carried by the lower frame 16 and a second set of shuffle members carried by the upper frame 19 are spaced apart to provide a sizing opening between a shuffle member 13 and an auxiliary shuffle member 113 which is pivotally mounted at 105 on the frame 19 and has a raised portion at the front terminating in a corner 111 which is spaced from the corner 112 of one of the upper and adjacent shuffle member 13 to provide a sizing opening.

The auxiliary shuffle member 113 forms one of a third series of reciprocating members, the members 113 being mounted on and driven by the frame members 19. Also a feed control and ejector member 103 forms one of a fourth set of reciprocating members, which are carried by the frame members 16 to reciprocate therewith.

The shuffle or sizing member 113 has a pivotal mounting at 105, also cooperates with an arcuate slot 104 in the frame 19 and has an aperture through which a bolt 106 passes to hold the shuffle member in adjusted position for a particular size of opening. A plate 107 extends across the front of plate **111*a* and is secured to frame member 19 so as to close the gap, if any, between the auxiliary sizing shuffle member 113 and the adjacent reciprocating shuffle member 14**.

An auxiliary feed control and ejector member for the sizing mechanism is provided in the form of a shuffle member 103 carried by the lower frame 16 adjacent each shuffle member 13 forming a part of the sizing opening. This shuffle member 103 therefor travels with the shuffle members 14 and is spaced on the plate 16 so that it will project beyond the shuffle member 14 as seen in FIG. 9 when a potato A has been moved over the article supporting surface of the shuffle member 13 and dropped over the end edge. Subsequently, as the shuffle member 103 retracts as seen in FIG. 10, for example, the sizing opening between the corners 111 and 112 is open to allow potatoes to fall therethrough. If the potato is too large (as shown in the case of the potato A in FIG. 10) it will remain in the opening until the next forward stroke of the shuffle or ejector member 103 which projects through the opening throughout its extent and will reject any potatoes lodged therein.

It will be seen from the above description that the auxiliary shuffle member 103 (FIG. 9) not only performs a controlling function on the articles being sized by providing a temporary resting place for the article immediately above the sizing opening between the corners 111 and 112. Subsequently, upon the withdrawal of this member 103 the potato resting on the surface is allowed to drop into the sizing opening as seen in FIG. 10, for example, and is of the proper size to pass therethrough. It will be noted also that the control exercised over the sizing operation and over the rejection of articles too large to be sized in a particular opening is all performed by permanently mounted reciprocating members.

Referring to FIGS. 12 and 13 there is shown a further modified form of the invention wherein a first set of shuffle members 14 carried by the lower frame 16 and a second set of shuffle members 13 carried by the upper frame 19 are spaced apart to provide an unobstructed sizing opening between a shuffle member 14 and an auxiliary adjustable shuffle member 113 which is pivotally mounted at each end at 105 on the frame 19 and has a raised platform portion 115 at the front which is spaced from the corner 112 of one of the upper and adjacent shuffle member **14*a* to provide a sizing opening with the member 14*a* as indicated at 120. This member 14*a* presents a solid surface on the underneath side for rolling of an article too large to go through the sizing opening 120 up the platform 115 for discharge. It is also thinner than the other members 14** to conserve length and weight.

The auxiliary shuffle member 113 forms one of a third series of reciprocating members, the members 113 being mounted on and driven by the frame members 19.

Referring to FIGS. 12, 13 and 14, for example, it will be noted in FIG. 14 that the sizing opening 120 is actually defined at the time the shuffle member 14*a* is in its furthest retracted position and is measured by the distance of a perpendicular line erected on the surface of the platform 115 and passing through the lower corner of the front edge of the member 14*a*. It will be noted that the front faces of the members 113 have a lower reciprocation path with respect to the frame members 19 than do the next adjacent members 13 which are higher. Also, the next adjacent member 14 has a lower path of reciprocation than the other members 14 and 14*a* at either side to bring the products downwardly for the sizing position and then to feed them upwardly in place to drop in front of the next sizing opening. Each of the sizing openings 120 from left to right may be adjusted to successively larger spacings so that the smallest articles will be sized first, etc.

The shuffle or sizing member 113 has a pivotal mounting at 105, also cooperates with an arcuate slot 104 in the frame 19 and has an aperture through which a bolt 106 passes to hold the shuffle member in adjusted position for a particular size of opening. An angle 107 extends across the front of platform 115 and is secured to frame member 19 so as to close the gap, if any, between the auxiliary sizing shuffle member 113 and the adjacent reciprocating shuffle member 14.

To summarize the sizing operation, an article is presented to the sizing opening when a member 14*a* is in its furthest retracted position by dropping the article onto the platform 115 and if the article is small enough to pass through the opening it will do so. If not, it will be rolled upwardly and/or pushed upwardly by the adjacent member 14*a* over the end of the platform 115 to be further progressed along the shuffle members and to be similarly presented to the next sizing opening.

While I have shown and described a certain preferred embodiment of the invention it is apparent that the invention is capable of variation and modification from the form shown so that the scope thereof should be limited only by the proper scope of the claims appended hereto.

I claim:

1. In a shuffle feed sizing mechanism having a first set of transversely disposed shuffle members, a second set of similarly disposed shuffle members arranged in alternating parallel relation with said first set to provide transverse valleys;

means for effecting reciprocation of at least one set of said members to advance an article from valley to valley of the feed mechanism, each of said shuffle members having a front face and an upper face forming a corner with said front face and providing an article supporting surface, one of said shuffle members of said first set having a sizing opening in the front or article advancing face thereof;

means disposed parallel to said one shuffle member for defining a sizing opening therewith; and means movable with one of said sets of shuffle members and for entering said sizing opening during relative movement of the parts in the extreme relative reciprocated position of the members to reject any article too large to pass through the sizing opening.

2. In a shuffle feed sizing mechanism having a first set of transversely disposed shuffle members, a second set of similarly disposed shuffle members arranged in alternating parallel relation with said first set to provide transverse valleys;

means for effecting reciprocation of at least one set of said members to advance an article from valley to valley of the feed mechanism, each of said shuffle members having a front face and an upper face forming a corner with said front face and providing an article supporting surface, one of said shuffle members of said first set forming a part of means defining a sizing opening adjacent the front or article advancing face thereof;

means disposed parallel to said one shuffle member for defining a sizing opening therewith, said first set of transversly disposed shuffle members and said means disposed parallel being relatively adjustable to each other, and a feed control shuffle member movable with one of said sets of shuffle members and moveable into and out of said sizing opening during relative movement of the parts to reject any article too large to pass through the sizing opening.

3. In a shuffle feed sizing mechanism as recited in claim 2, in which said feed control shuffle member is adapted to be projected beyond one of another set of said shuffle members so as to provide a ledge on which an article to be sized can be retarded or held above the sizing opening and allowed to be moved into the sizing opening as said feed control shuffle member is retracted into the sizing opening.

4. In a shuffle feed sizing mechanism having a first set of transversely disposed shuffle members, a second set of similarly disposed shuffle members arranged in alternating parallel relation with said first set to provide transverse valleys;

means for effecting reciprocation of at least one set of said members to advance an article from valley to valley of the feed mechanism, each of said shuffle members having a front face and an upper face forming a corner with said front face and providing an article supporting surface, one of said shuffle members of said first set forming a part of means defining a sizing opening in its fully retracted position adjacent the front or article advancing face thereof, a platform carried by a shuffle member of the other set and spaced from said retracted shuffle member for defining a sizing opening therewith; and means movable with one of said sets of shuffle members and operatively related to said sizing opening during relative movement of the parts to reject any article too large to pass through the sizing opening.

5. In a shuffle feed sizing mechanism as recited in claim 4, in which said retracted shuffle member has an article rolling surface on its lower face.

6. In a shuffle feed sizing mechanism having a first set of transversely disposed shuffle members, a second set of similarly disposed shuffle members arranged in alternating parallel relation with said first set to provide transverse valleys;

means for effecting reciprocation of at least one set of said members to advance an article from valley to valley of the feed mechanism, each of said shuffle members having a front face and an upper face forming a corner with said front face and providing an article supporting surface, one of said shuffle members of said first set forming a part of means defining a sizing opening adjacent the front or article advancing face thereof;

means disposed parallel to said one shuffle member for defining a sizing opening therewith, a shuffle member adjacent the sizing opening having its article engaging face in a more retracted position with reference to the supporting frame than the next adjacent shuffle members on each side thereof; and means movable with one of said sets of shuffle members and operatively related to said sizing opening during relative movement of the parts to reject any article too large to pass through the sizing opening.

7. In a shuffle feed sizing mechanism having a first set of transversely disposed shuffle members, a second set of similarly disposed shuffle members arranged in alternating parallel relation with said first set to provide transverse valleys;

means for effecting reciprocation of at least one set of said members to advance an article from valley to valley of the feed mechanism, each of said shuffle members having a front face and an upper face forming a corner with said front face and providing an article supporting surface, one of said shuffle members of said first set forming a part of means defining a sizing opening adjacent the front or article advancing face thereof;

means disposed parallel to said one shuffle member for defining a sizing opening therewith, one of said members defining the sizing opening being mounted for adjustment on the adjacent frame part to control the size of article to be admitted through the sizing opening; and means movable with one of said sets of shuffle members and operatively related to said sizing opening during relative movement of the parts to reject any article too large to pass through the sizing opening.

* * * * *